US009864330B2

(12) United States Patent
Hashimoto et al.

(10) Patent No.: US 9,864,330 B2
(45) **Date of Patent: *Jan. 9, 2018**

(54) DEVELOPER CARTRIDGE

(71) Applicant: Brother Kogyo Kabushiki Kaisha, Nagoya-shi, Aichi-ken (JP)

(72) Inventors: Junichi Hashimoto, Toyohashi (JP); Isao Kishi, Nagoya (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/953,766

(22) Filed: Nov. 30, 2015

(65) Prior Publication Data

US 2016/0077465 A1 Mar. 17, 2016

Related U.S. Application Data

(63) Continuation of application No. 14/560,338, filed on Dec. 4, 2014, now Pat. No. 9,201,390, which is a (Continued)

(30) Foreign Application Priority Data

Sep. 11, 2009 (JP) ..... 2009-210653

(51) Int. Cl.
*G03G 15/04* (2006.01)
*G03G 21/16* (2006.01)

(Continued)

(52) U.S. Cl.
CPC ..... *G03G 21/1676* (2013.01); *G03G 15/0808* (2013.01); *G03G 15/0865* (2013.01);

(Continued)

(58) Field of Classification Search
CPC ..... G03G 15/0832; G03G 21/18; G03G 21/1814; G03G 21/1846

(Continued)

(56) References Cited

U.S. PATENT DOCUMENTS 7,203,452 B2 4/2007 Miyawaki et al.
7,336,916 B2 2/2008 Jung et al.

(Continued)

FOREIGN PATENT DOCUMENTS

EP 1 837 712 A1 9/2007
EP 2 207 067 A2 7/2010

(Continued)

OTHER PUBLICATIONS

Aug. 7, 2013—(US) Notice of Allowance—U.S. Appl. No. 13/556,721.

(Continued)

*Primary Examiner* — Benjamin Schmitt
(74) *Attorney, Agent, or Firm* — Banner & Witcoff, Ltd.

(57) ABSTRACT

A developer cartridge is described. The developer cartridge detachably mountable on a tandem type photosensitive unit slidable to a drawn-out position and a mounted position with respect to an image forming apparatus body may include a casing; a developer carrier rotatably supported on one end portion of the casing for carrying a developer; a pair of upright portions arranged on another end portion of the casing at an interval from each other in the axial direction of the developer carrier to extend from another end portion of the casing in a detaching direction for the developer cartridge; and an elastically deformable coupling portion extending in the axial direction of the developer carrier for coupling the upright portions with each other.

17 Claims, 11 Drawing Sheets

Related U.S. Application Data continuation of application No. 14/073,154, filed on Nov. 6, 2013, now Pat. No. 9,052,684, which is a continuation of application No. 13/556,721, filed on Jul. 24, 2012, now Pat. No. 8,600,264, which is a continuation of application No. 12/731,788, filed on Mar. 25, 2010, now Pat. No. 8,280,280.

(51) Int. Cl.
*G03G 21/18* (2006.01)
*G03G 15/01* (2006.01)
*G03G 15/08* (2006.01)

(52) U.S. Cl.
CPC ..... *G03G 21/1814* (2013.01); *G03G 21/1846* (2013.01); *G03G 15/0121* (2013.01); *G03G 15/0855* (2013.01); *G03G 15/0875* (2013.01); *G03G 21/1821* (2013.01); *G03G 2215/0141* (2013.01); *G03G 2215/0634* (2013.01); *G03G 2221/1684* (2013.01); *G03G 2221/1869* (2013.01)

(58) Field of Classification Search
USPC ..... 399/112, 119
See application file for complete search history.

(56) References Cited

U.S. PATENT DOCUMENTS

| | | | | |
|---|---|---|---|---|
| 7,555,245 | B2 | 6/2009 | Kamimura | |
| 7,567,769 | B2 | 7/2009 | Noguchi et al. | |
| 7,653,326 | B2 | 1/2010 | Ozawa | |
| 7,715,746 | B2 | 5/2010 | Tanabe et al. | |
| 7,778,567 | B2 | 8/2010 | Igarashi et al. | |
| 7,787,805 | B2 | 8/2010 | Kamimura | |
| 7,835,665 | B2 | 11/2010 | Okabe et al. | |
| 7,970,314 | B2 | 6/2011 | Kamimura | |
| 8,059,988 | B2 | 11/2011 | Kanno et al. | |
| 8,145,095 | B2 | 3/2012 | Sakurai et al. | |
| 8,280,280 | B2 | 10/2012 | Hashimoto et al. | |
| 8,559,845 | B2 | 10/2013 | Okabe et al. | |
| 8,600,264 | B2 | 12/2013 | Hashimoto et al. | |
| 2001/0055494 | A1 | 12/2001 | Katakabe et al. | |
| 2007/0036582 | A1 | 2/2007 | Okabe | |
| 2007/0077086 | A1 | 4/2007 | Takakuwa et al. | |
| 2007/0183814 | A1 | 8/2007 | Kamimura | |
| 2007/0217816 | A1 | 9/2007 | Shiraki | |
| 2007/0217818 | A1* | 9/2007 | Shiraki | G03G 15/0896 399/111 |
| 2008/0159781 | A1 | 7/2008 | Noguchi et al. | |
| 2008/0240778 | A1 | 10/2008 | Ishikawa et al. | |
| 2008/0317499 | A1 | 12/2008 | Nishimura | |
| 2009/0232555 | A1 | 9/2009 | Kamimura | |
| 2010/0135693 | A1 | 6/2010 | Okabe et al. | |
| 2010/0284707 | A1 | 11/2010 | Kamimura | |
| 2011/0211865 | A1 | 9/2011 | Hashimoto et al. | |

FOREIGN PATENT DOCUMENTS

| | | | |
|---|---|---|---|
| JP | 62-69245 | U | 4/1987 |
| JP | 2007-101637 | A | 4/2007 |
| JP | 2007-178654 | A | 7/2007 |
| JP | 2008-165027 | A | 7/2008 |

OTHER PUBLICATIONS

Jan. 10, 2012—(JP) Notification of Reasons for Refusal—App 2009-210653—Eng Tran.
Mar. 1, 2012—(US) Notice of Allowance—U.S. Appl. No. 12/731,809.
Mar. 12, 2012—(CN) First Office Action—App 201010158223.2—Eng Tran.
Apr. 12, 2012—(CN) First Office Action—App 201010158199.2—Eng Tran.
Nov. 5, 2012—(CN) Second Office Action—App 201010158223.2—Eng Tran.
Dec. 7, 2012—(US) Non-Final Office Action—U.S. Appl. No. 13/556,721.
Jul. 5, 2011—(JP) Notification of Reasons for Refusal—App 2009-210652—Partial Eng Tran.
Sep. 20, 2011—(EP) Extended Search Report—App 10003228.3.
Aug. 19, 2011—(EP) Extended Search Report—App 10003227.5.
Feb. 7, 2012—(US) Non-Final Office Action—U.S. Appl. No. 12/731,788.
May 29, 2012—(US) Notice of Allowance—U.S. Appl. No. 12/731,788.
Aug. 29, 2014—(US) Non-Final Office Action—U.S. Appl. No. 14/029,356.
Jul. 12, 2011—(JP) Notification of Reasons for Refusal—App 2009-210653—Eng Tran.
Nov. 21, 2014—(CN) Second Office Action—App 201210364400.1—Eng Tran.
Feb. 4, 2015—(US) Notice of Allowance—U.S. Appl. No. 14/029,356.
Mar. 19, 2015—(US) Non-Final Office Action—U.S. Appl. No. 14/560,379.
Mar. 17, 2015—(US) Non-Final Office Action—U.S. Appl. No. 14/560,307.
Mar. 19, 2015—(US) Non-Final Office Action—U.S. Appl. No. 14/560,338.
Jul. 9, 2015—(US) Notice of Allowance—U.S. Appl. No. 14/560,307.
Jun. 18, 2015—(EP) Extended Search Report—App 14186536.0.
Jul. 29, 2015—(US) Notice of Allowance—U.S. Appl. No. 14/560,379.
Jul. 30, 2015—(US) Notice of Allowance—U.S. Appl. No. 14/560,338.
Nov. 6, 2015—(US) Non-Final Office Action—U.S. Appl. No. 14/735,669.
Nov. 18, 2015—(EP) Extended European Search Report—App 15155711.3.
Apr. 11, 2016—(US) Notice of Allowance—U.S. Appl. No. 14/735,669.
Mar. 9, 2017—U.S. Non-Final Office Action—U.S. Appl. No. 15/209,243.
Aug. 11, 2017—U.S. Notice of Allowance—U.S. Appl. No. 15/209,243.

* cited by examiner

DEVELOPER CARTRIDGE

CROSS REFERENCE TO RELATED APPLICATION

This application is a continuation of U.S. patent application Ser. No. 14/560,338 filed Dec. 4, 2014, which is a continuation of U.S. patent application Ser. No. 14/073,154 filed Nov. 6, 2013, issued as U.S. Pat. No. 9,052,684 on Jun. 9, 2015, which is a continuation of U.S. patent application Ser. No. 13/556,721 filed on Jul. 24, 2012, issued as U.S. Pat. No. 8,600,264 on Dec. 3, 2013, which is a continuation of and claims priority to U.S. patent application Ser. No. 12/731,788 filed Mar. 25, 2010, which claims priority to Japanese Patent Application No. 2009-210653 filed on Sep. 11, 2009, the disclosure of which is hereby incorporated into the present application by reference.

TECHNICAL FIELD

The present invention relates to a developer cartridge provided on an image forming apparatus such as a color laser printer.

BACKGROUND

A tandem type color laser printer including a plurality of photosensitive bodies, corresponding to toners of yellow, magenta, cyan and black respectively, parallelly arranged in a prescribed direction and a plurality of developer cartridges corresponding to the photosensitive bodies respectively for feeding the toners is known as a color printer of an electrophotographic system.

For example, a developer cartridge including a developer frame storing a toner and a developer cartridge grasp portion provided on the upper wall of the developer frame is proposed as a developer cartridge provided on such a tandem type color laser printer.

In the developer cartridge, the developer cartridge grasp portion includes a recess formed by concaving the upper wall of the developer frame downward and a grip provided on the rear end portion of the recess, while the grip includes grasp side walls extending upward from both end portions of the recess in the width direction and a grasp central portion extended between the upper end portions of the grasp side walls. Such developer cartridges are mounted on a drum unit detachably mounted on a main body casing, to be arranged in parallel with one another.

In the developer cartridge, however, the grip includes the grasp side walls extending upward and the grasp central portion extended between the upper end portions of the grasp side walls. In other words, the grip is formed to protrude upward.

When the drum unit is mounted on the main body casing, therefore, a peripheral member may interfere with the grip from above. In this case, the grip or the peripheral member interfering therewith may be broken.

For example, the recess of the developer frame may be increased in size to reduce the quantity of the upward protrusion of the grip, so that the peripheral member does not easily interfere with the grip.

If the recess of the developer cartridge is increased in size to reduce the quantity of the upward projection of the grip, however, it follows that the user inserts his/her fingers into a space between the developer cartridge and another developer cartridge adjacent thereto in order to grasp the grip since such developer cartridges are parallelly arranged in the drum unit, and it may be difficult to access the grip.

When the recess of the developer cartridge is increased in size, further, a toner storage chamber of the developer frame is responsively reduced in size, and the quantity of the toner stored therein is also reduced.

SUMMARY

Accordingly, an object of the present invention is to provide a developer cartridge easily detachably mountable on a tandem type photosensitive unit and capable of preventing breakage resulting from interference with a peripheral member when the tandem type photosensitive unit is slid with respect to an image forming apparatus body.

One aspect of the present invention may provide a developer cartridge detachably mountable on a tandem type photosensitive unit slidable to a drawn-out position and a mounted position with respect to an image forming apparatus body, including: a casing; a developer carrier rotatably supported on one end portion of the casing for carrying a developer; a pair of upright portions arranged on another end portion of the casing at an interval from each other in the axial direction of the developer carrier to extend from another end portion of the casing in a detaching direction for the developer cartridge; and an elastically deformable coupling portion extending in the axial direction of the developer carrier for coupling the upright portions with each other.

DETAILED DESCRIPTION

Embodiments of the present invention are now described with reference to the drawings.

<First Embodiment>

1. Overall Structure of Color Laser Printer

Figure 1:
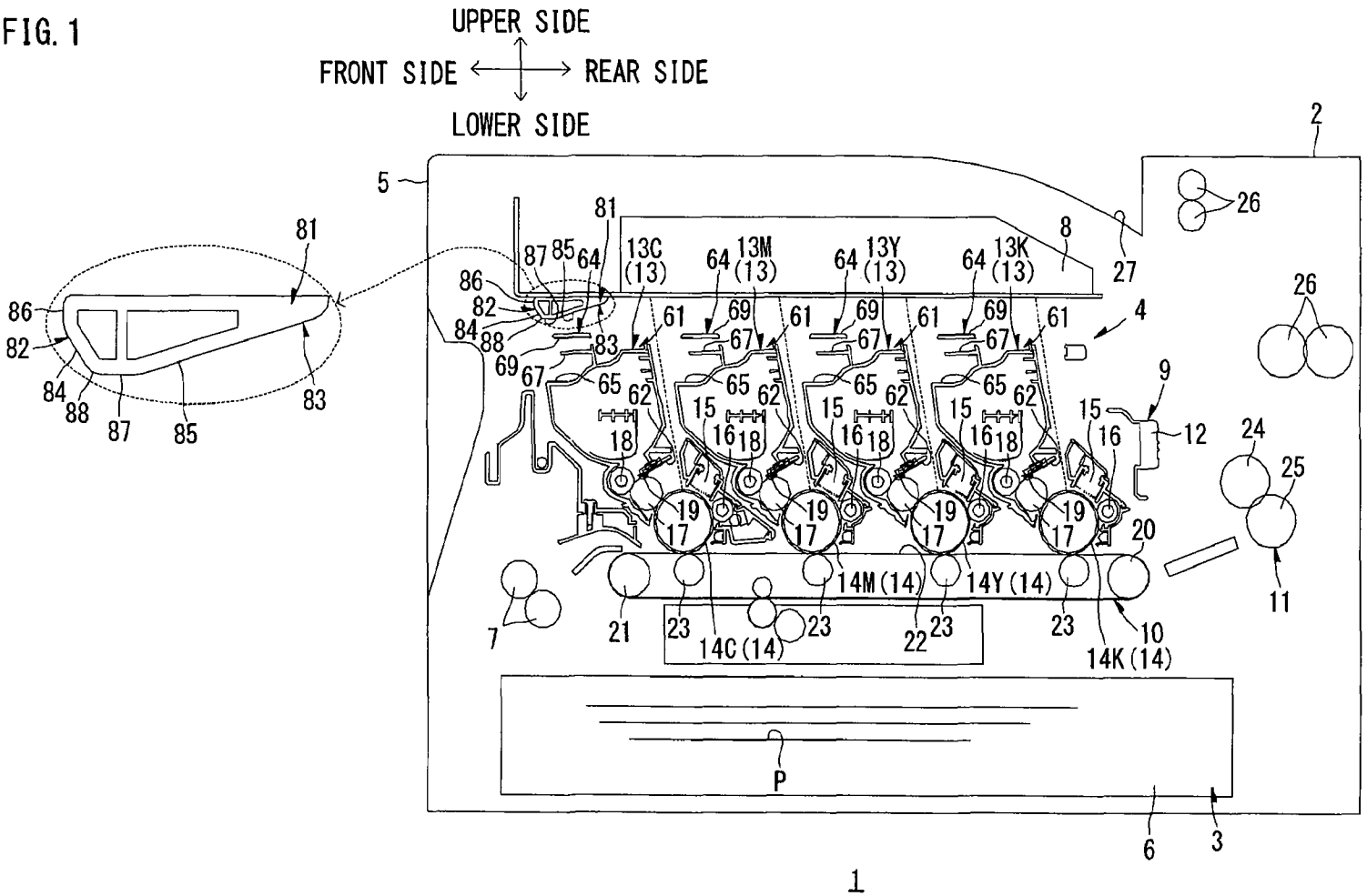
FIG. 1 is a side sectional view showing a color laser printer as an example of an image forming apparatus according to an embodiment of the present invention.

As shown in FIG. 1, a color laser printer 1 as an example of an image forming apparatus is a transverse direct tandem type color laser printer. The color laser printer 1 includes a sheet feeding section 3 for feeding sheets P and an image forming section 4 for forming images on the fed sheets P in a main body casing 2 as an example of an image forming apparatus body.

(1) Main Body Casing

The main body casing 2 is in the form of a box, generally rectangular in side elevational view, storing the sheet feeding section 3 and the image forming section 4, and an attachment/detachment port 30 for attaching/detaching a process unit 9 (described later) is formed on one sidewall thereof (see FIG. 7). Further, a front cover 5 covering the attachment/detachment port 30 is provided on the sidewall. The front cover 5 is provided to be swingable on the lower end portion thereof with respect to the main body casing 2, and inclined toward one side, thereby exposing the attachment/detachment port 30.

In the following description, it is assumed that the side (the left side in FIG. 1) provided with the front cover 5 is the front side, and the side (the right side in FIG. 1) opposite thereto is the rear side. The right and left sides are set with reference to the color laser printer 1 as viewed from the front side. In other words, the front side in the plane of FIG. 1 is the right side, and the back side in the plane of FIG. 1 is the left side.

(2) Sheet Feeding Section

The sheet feeding section 3 includes a sheet feeding tray 6 storing the sheets P. The sheet feeding tray 6 is detachably mounted on the bottom portion in the main body casing 2. A pair of resist rollers 7 are provided above the front end portion of the sheet feeding tray 6.

The sheets P stored in the sheet feeding tray 6 are fed one by one toward the space between the resist rollers 7, and transported toward the image forming section 4 (between photosensitive drums 14 (described later) and a transport belt 22 (described later)) at prescribed timing.

(3) Image Forming Section

The image forming section 4 includes a scanner unit 8, the process unit 9 as an example of a tandem type photosensitive unit, a transfer unit 10 and a fixing unit 11.

(3-1) Scanner Unit

The scanner unit 8 is arranged in an upper portion of the main body casing 2. The scanner unit 8 emits laser beams toward four photosensitive drums 14 (described later) on the basis of image data respectively as shown by broken lines, and exposes the photosensitive drums 14 (described later).

(3-2) Process Unit (3-2-1) Structure of Process Unit

The process unit 9 is arranged under the scanner unit 8 and above the transfer unit 10, and includes a process frame 12 as an example of a frame and a plurality of (four) developer cartridges 13 corresponding to respective colors. The process unit 9 is provided to be slidable to a mounted position (see FIG. 1) mounted on the main body casing 2 to be capable of image formation and a drawn-out position (see FIG. 7) drawn out of the main body casing 2 through the attachment/detachment port 30.

The process frame 12 is slidable with respect to the main body casing 2 along the anteroposterior direction, and supports the photosensitive drums 14 as examples of photosensitive bodies, scorotron chargers 15 and drum cleaning rollers 16.

The plurality of (four) photosensitive drums 14 are parallelly arranged at intervals in the anteroposterior direction, to be along the right-and-left direction. More specifically, a black photosensitive drum 14K, a yellow photosensitive drum 14Y, a magenta photosensitive drum 14M and a cyan photosensitive drum 14C are successively arranged from the front side toward the rear side.

The scorotron chargers 15 are arranged obliquely above the rear sides of the photosensitive drums 14, to be opposed to the photosensitive drums 14 at intervals.

The drum cleaning rollers 16 are arranged on the rear sides of the photosensitive drums 14, to be opposed to and in contact with the photosensitive drums 14 respectively.

Each developer cartridge 13 is detachably supported by the process frame 12 on the upper side of each photosensitive drum 14, to correspond to each photosensitive drum 14. More specifically, a black developer cartridge 13K, a yellow developer cartridge 13Y, a magenta developer cartridge 13M and a cyan developer cartridge 13C are successively arranged from the rear side toward the front side. Each developer cartridge 13 includes a developing roller 17 as an example of a developer carrier.

The developing roller 17 is rotatably supported on the lower end of the corresponding developer cartridge 13 to be exposed from the rear side, and opposed to and in contact with the photosensitive drum 14 from the upper side, as described later.

Each developer cartridge 13 includes a feed roller 18 feeding the corresponding toner to the corresponding developing roller 17 and a layer-thickness regulating blade 19 regulating the thickness of the toner fed to the developing roller 17, while the toner as an example of a developer corresponding to each color is stored in a space above the feed roller 18 and the layer-thickness regulating blade 19.

(3-2-2) Developing Operation in Process Unit

The toner stored in the developer cartridge 13 is fed to the feed roller 18, further fed to the developing roller 17, and frictionally charged to positive polarity between the feed roller 18 and the developing roller 17.

The thickness of the toner fed to the developing roller 17 is regulated by the layer-thickness regulating blade 19 following rotation of the developing roller 17, and the toner is carried on the surface of the developing roller 17 as a thin layer having a constant thickness.

On the other hand, the surface of each photosensitive drum 14 is uniformly positively charged by the corresponding scorotron charger 15 following rotation of the photosensitive drum 14, and thereafter exposed by high-speed scanning with the corresponding laser beam (see each broken line in FIG. 1) from the scanner unit 8. Thus, an electrostatic latent image corresponding to an image to be formed on each sheet P is formed on the surface of the photosensitive drum 14.

When the photosensitive drum 14 further rotates, the positively charged toner carried on the surface of the developing roller 17 is fed to the electrostatic latent image formed on the surface of the photosensitive drum 14. Thus, the electrostatic latent image formed on the photosensitive drum 14 is visualized, and a toner image resulting from reversal development is carried on the surface of the photosensitive drum 14.

(3-3) Transfer Unit

The transfer unit 10 is arranged above the sheet feeding section 3 and under the process unit 9 along the anteroposterior direction in the main body casing 2. The transfer unit 10 includes a driving roller 20, a driven roller 21, the transport belt 22 and four transfer rollers 23.

The driving roller 20 and the driven roller 21 are opposed to each other at an interval in the anteroposterior direction.

The transport belt 22 is wound on the driving roller 20 and the driven roller 21, to be opposed to each photosensitive drum 14 in the vertical direction so that an upper portion thereof is in contact with each photosensitive drum 14. The transport belt 22 is driven by the driving roller 20 to circulate, so that the upper portion of the transport belt 22 in contact with each photosensitive drum 14 moves from the front side toward the rear side.

Each transfer roller 23 is provided to be opposed to each photosensitive drum 14 through the upper portion of the transport belt 22.

The transport belt 22 transports the sheets P fed from the sheet feeding section 3 from the front side toward the rear side, to successively pass through transfer positions where the photosensitive drums 14 and the transfer rollers 23 are opposed to one another respectively. During the transportation, the toner images of the respective colors carried on the photosensitive drums 14 are successively transferred to the sheets P, and color images are formed.

Any of the toners may remain on the outer peripheral surface of the corresponding photosensitive drum 14 after the corresponding toner image is transferred from the photosensitive drum 14 to the sheets P. In this case, the residual waste toner is transferred to the outer peripheral surface of the corresponding drum cleaning roller 16 by a cleaning bias applied to the drum cleaning roller 16 when the photosensitive drum 14 is opposed to the drum cleaning roller 16 upon rotation, and retained on the drum cleaning roller 16.

(3-4) Fixing Unit

The fixing unit 11 is arranged on the rear side of the transfer unit 10, and includes a heating roller 24 and a pressure roller 25 opposed to the heating roller 24. In the transfer unit 10, the color image transferred to each sheet P is heated and pressurized to be thermally fixed to the sheet P when the sheet P passes through the space between the heating roller 24 and the pressure roller 25.

(4) Sheet Ejection

The sheet P to which the toner image has been fixed is transported by each sheet ejecting roller 26 to pass through a U-turn path (not shown), and ejected onto a sheet ejection tray 27 formed on the upper side the scanner unit 8.

2. Details of Process Unit (1) Process Frame

Figure 2:
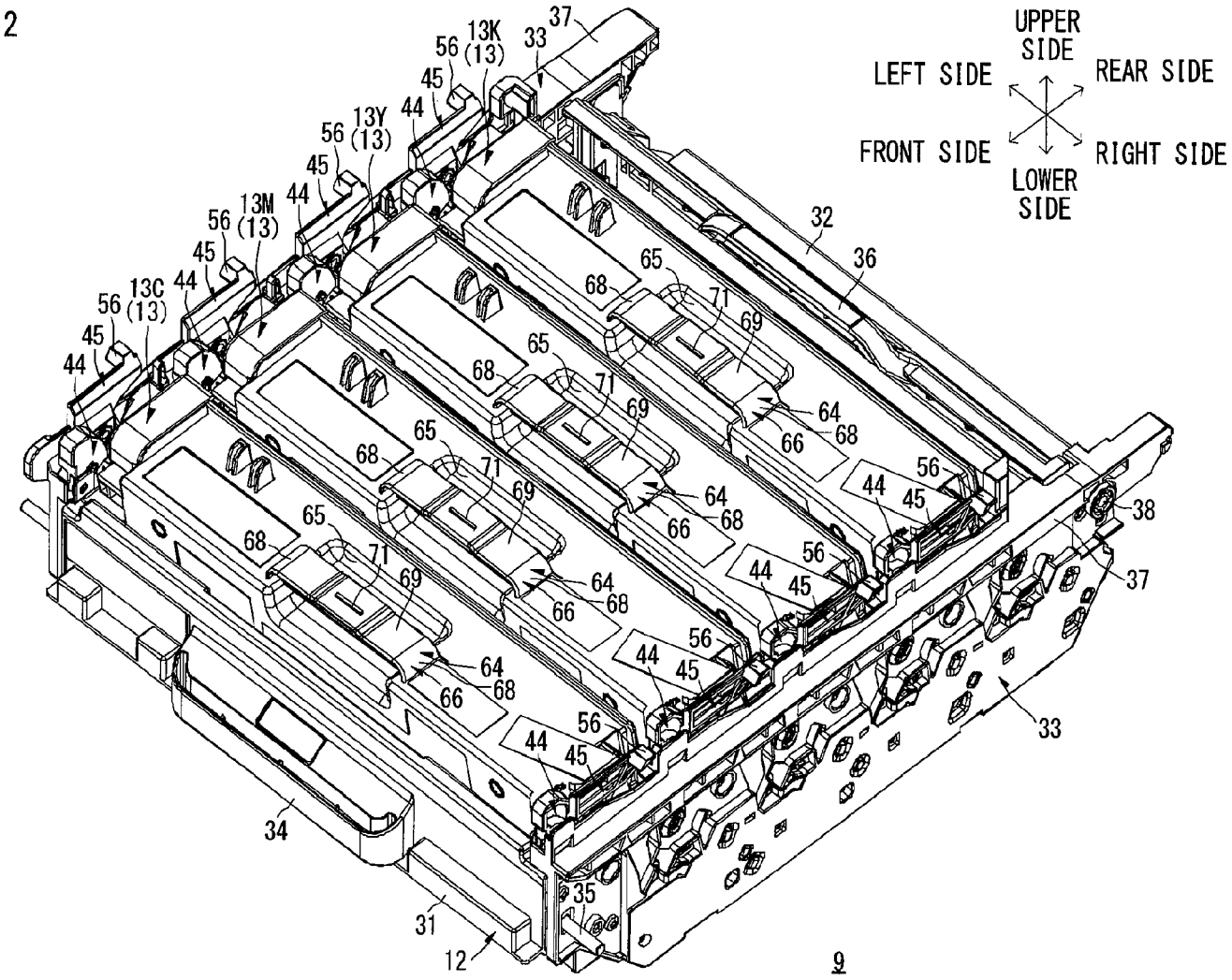
FIG. 2 is a perspective view of a process unit shown in FIG. 1, as viewed from the upper right side.
Figure 3:
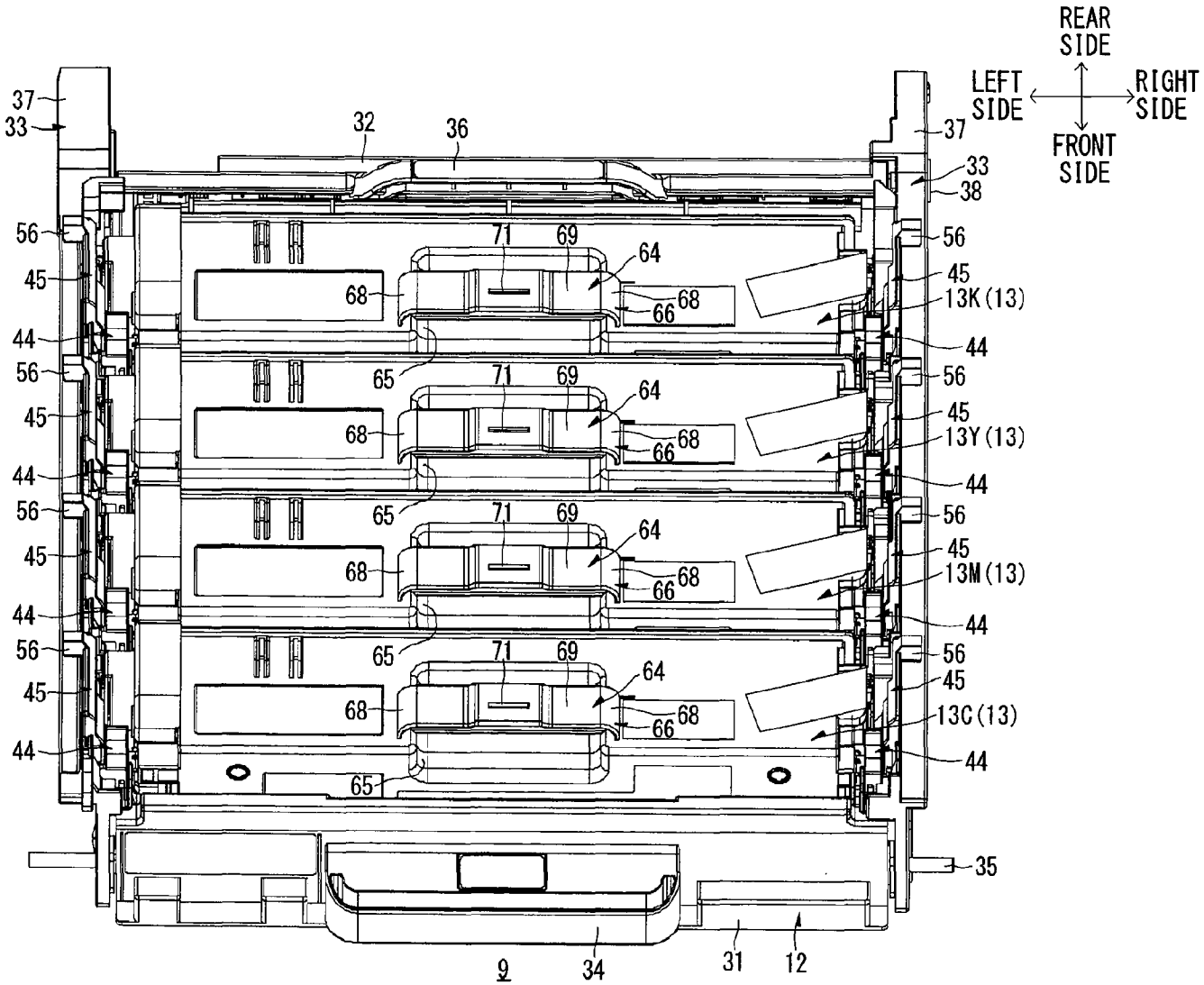
FIG. 3 is a plan view of the process unit shown in FIG. 1.

The process frame 12 is in the form of a generally rectangular frame longitudinal in the anteroposterior direction in plan view, as shown in FIGS. 2 and 3.

The process frame 12 includes a front beam 31, a rear beam 32, and a pair of right and left side plates 33.

The front beam 31 is extended between the front ends of the side plates 33. A front handle 34 is provided at the center of the front surface of the front beam 31 in the right-and-left direction.

A positioning shaft 35 extending in the right-and-left direction is inserted into the front beam 31, and both end portions of the positioning shaft 35 in the right-and-left direction pass through the front end portions of the side plates 33 to protrude outward in the right-and-left direction.

The rear beam 32 is extended between the rear ends of the side plates 33. A rear handle 36 extending in a state inclined toward the front upper side is provided at the center of the upper end of the rear beam 32 in the right-and-left direction.

The side plates 33 are opposed to each other at an interval from each other in the right-and-left direction. The side plates 33 are generally in the form of generally vertically extending rectangles longitudinal in the anteroposterior direction. Guide rails 37 and rollers 38 are provided on the upper edges of the side plates 33.

The guide rails 37 are projections extending along the anteroposterior direction and protruding outward in the right-and-left direction from the outer surfaces of the side plates 33 in the right-and-left direction. The guide rails 37 are formed over the entire upper edges of the side plates 33.

Figure 4:
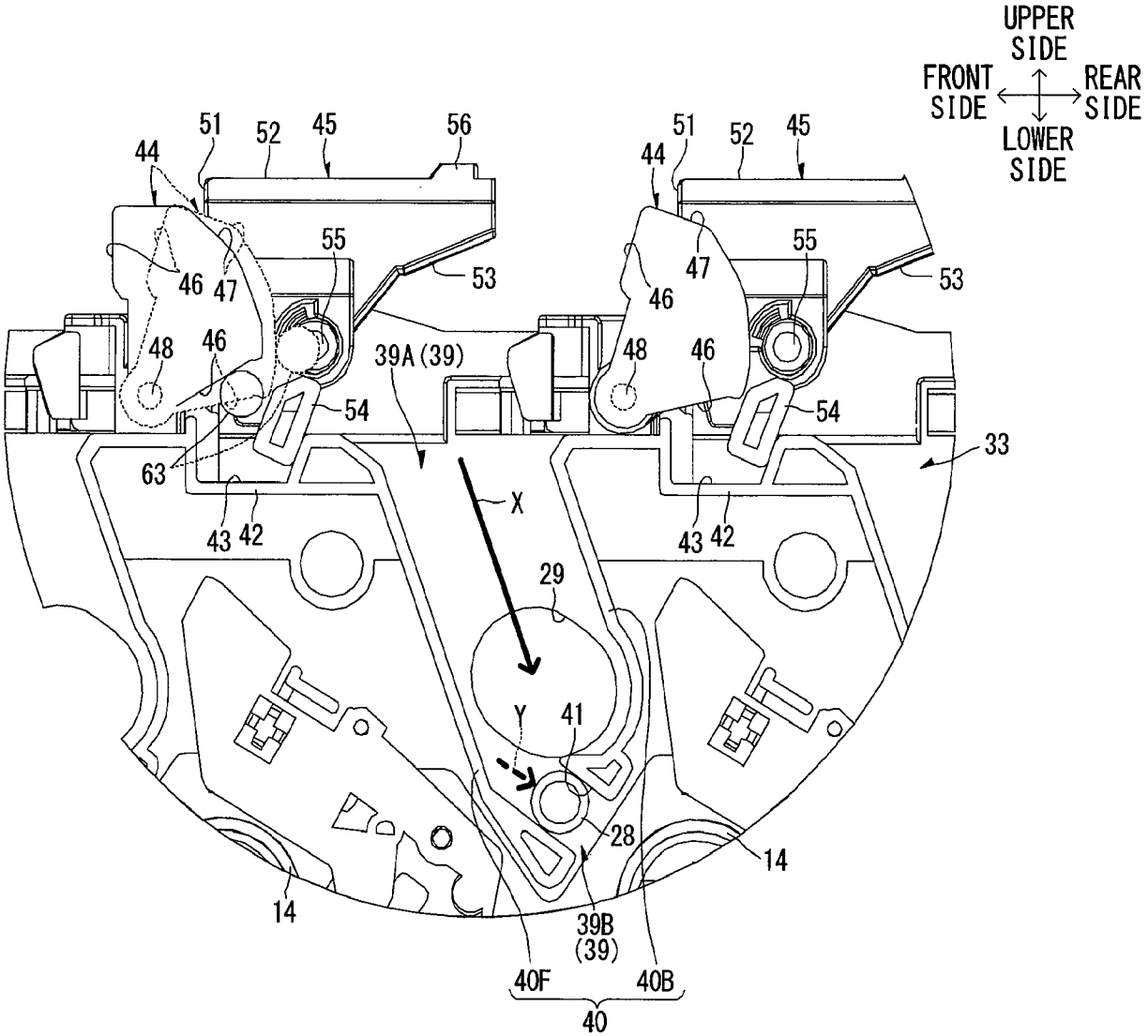
FIG. 4 is a right side elevational view of a left side plate shown in FIG. 3.

The rollers 38 are rotatably provided on the lower sides of the rear end portions of the guide rails 37. Guide grooves 39 are formed in the side plates 33, as shown in FIG. 4.

According to the first embodiment, structures related to the guide grooves 39, pressing cams 44 (described later) and detaching cams 45 (described later) are similar to one another in the side plates 33. In the following, therefore, the left side plate 33 is described in detail, and redundant description is omitted as to the right side plate 33. The left side plate 33 is simply referred to as the side plate 33.

Four guide grooves 39 are formed on the inner side surface of the side plate 33 in the right-and-left direction, at regular intervals in the anteroposterior direction. Each guide groove 39 extends from the upper edge of the side plate 33 obliquely toward the rear lower side (hereinafter referred to as a first inclinational direction X, shown by a thick solid line in FIG. 4) between the upper edge of the side plate 33 and the corresponding photosensitive drum 14.

More specifically, four pairs of guide ribs 40 are formed on the inner side surface of the side plate 33 in the right-and-left direction in response to the number of the guide grooves 39, to partition the guide grooves 39 respectively.

Each pair of guide ribs 40 (the guide ribs 40 on the front and rear sides are hereinafter referred to as a front rib 40F and a rear rib 40B respectively in relation to the anteroposterior direction of the guide ribs 40) extend along the first inclinational direction X at an interval anteroposteriorly from each other, and protrude inward in the right-and-left direction. The lower end portions of the guide ribs 40 are opposed to the corresponding photosensitive drum 14 slightly at an interval.

The front rib 40F generally linearly extends from the upper edge of the side plate 33 along the first inclinational direction X, and is thereafter bent rearward, to extend toward a direction (hereinafter referred to as a second inclinational direction Y, shown by a thick broken line in FIG. 4) along the radial direction of the photosensitive drum 14.

The rear rib 40B generally linearly extends from the upper edge of the side plate 33 along the first inclinational direction X, and is thereafter bent to generally arcuately swell out rearward. The lower end portion of the rear rib 40B is opposed to the lower end portion of the front rib 40F at a prescribed interval (generally corresponding to the diameter of a developing roller shaft 28 described later). In the rear end surface of the lower end portion of the rear rib 40B, an opposed surface 41 extending along the second inclinational direction Y is formed on a portion opposed to the lower end portion of the front rib 40F.

In other words, each guide groove 39 includes a first guide groove 39A extending from the upper end portion of the side plate 33 along the first inclinational direction X and a second guide groove 39B extending from the lower end portion of the first guide groove 39A along the second inclinational direction Y continuously to the first guide groove 39A.

The second guide groove 39B may not be directly continuous to the lower end of the first guide groove 39A, while the guide groove 39 may include not only the second guide groove 39B and the first guide groove 39A, but also a third portion (not shown) connecting the second guide groove 39B and the first guide groove 39A with each other.

In the left side plate 33, an insertion hole 29 passing through the side plate 33 in the right-and-left direction to be exposed in the guide groove 39 is formed in the vicinity of the lower end portion of each guide groove 39 (in the vicinity of the portion of the corresponding rear rib 40B arcuately swelling out rearward). A coupling member (not shown) for transmitting driving force of a motor (not shown) provided in the main body casing 2 is inserted into the insertion hole 29, and coupled to the developer cartridge 13 to be capable of transmitting the driving force. Thus, the developer cartridge 13 is driven.

On the inner side surface of the side plate 33 in the right-and-left direction, an extensional portion 42 is provided between each pair of adjacent guide grooves 39. The extensional portion 42 extends along the anteroposterior direction, and couples the upper edge of the front rib 40F forming the rear guide groove 39 and the upper edge of the rear rib 40B forming the front guide groove 39 with each other. A downwardly concaved recess 43 is formed on the upper surface of the extensional portion 42. In side elevational view, a portion partitioning the front side of the recess 43 is a generally vertical surface, a portion partitioning the lower side of the recess 43 is a generally horizontal surface, and a portion partitioning the rear side of the recess 43 is an inclined surface extending toward the rear upper side.

On the inner side surface of the side plate 33 in the right-and-left direction, the pressing cam 33 as an example of a pressing portion and the detaching cam 45 are provided to be adjacent to each extensional portion 42 from above. Four pressing cams 44 and four detaching cams 45 are provided to correspond to the guide grooves 39 respectively on the side plate 33 (see FIG. 2). In other words, the pressing cams 44 and the detaching cams 45 are provided on positions matching with both end portions of the developer cartridges 13 in the right-and-left direction when the developer cartridges 13 are mounted on the process frame 12.

Each pressing cam 44 is generally sectorial as viewed from the right-and-left direction. More specifically, the pressing cam 44 includes a pair of upper and lower planar portions 46 at an interval widened toward the rear upper side and a curved portion 47 connecting the rear upper ends of the planar portions 46 with each other and generally arcuately swelling out toward the rear upper side.

The pressing cam 44 has a rotating shaft 48 extending outward in the right-and-left direction in the vicinity of the portions of the front lower ends of the planar portions 46 coupled with each other. The rotating shaft 48 is supported on the inner side surface of the corresponding side plate 33 in the right-and-left direction. Thus, the pressing cam 44 is pivotable on the rotating shaft 48.

In normal, the pressing cam 44 is urged clockwise in right side elevational view by an urging member (not shown).

Thus, the pressing cam 44 is arranged on a standby position (shown by a broken line in FIG. 4) inclined rearward by the urging force of the urging member (not shown) in normal, and pivoted against the urging force of the urging member (not shown) to be uprighted and moved to a pressing position (shown by a solid line in FIG. 4).

Each detaching cam 45 is adjacent to the corresponding pressing cam 44 in a noncontact state from the rear side and from the outer side in the right-and-left direction. The detaching cam 45 is generally in the form of a right triangle having a right-angled portion on the front upper end as viewed from the right-and-left direction. The detaching cam 45 includes a generally vertically extending vertical portion 51, a horizontal portion 52 generally horizontally extending rearward from the upper end of the vertical portion 51 and an inclined portion 53 continuously extending from the rear end of the horizontal portion 52 toward the front lower side to be connected to the lower end of the vertical portion 51. The horizontal portion 52 is positioned upward beyond the guide rail 37 provided on the upper edge of the corresponding side plate 33 (see FIG. 2).

A detaching portion 54 is integrally provided on the lower end of the inclined portion 53. The detaching portion 54 protrudes from the detaching cam 45 inward in the right-and-left direction, and is generally in the form of a trapezoid notched on the front side in the upper end portion in side elevational view. The detaching portion 54 is opposed to the pressing cam 44 in the anteroposterior direction.

A protrusion 56 protruding upward and outward in the right-and-left direction is integrally provided on the rear end of the horizontal portion 52 of the detaching cam 45 (see FIG. 2).

The detaching cam 45 has a rotating shaft 55 extending outward in the right-and-left direction on the upper side of the detaching portion 54 in the inclined portion 53. The rotating shaft 55 is supported on the inner side surface of the corresponding side plate 33 in the right-and-left direction. Thus, the detaching cam 45 is pivotable on the rotating shaft 55.

In normal, the detaching cam 45 is urged anticlockwise in right side elevational view by an urging member (not shown).

Thus, the detaching portion 54 fits in the recess 43 of the corresponding extensional portion 42 in normal, so that the detaching cam 45 is arranged on a standby position inclined toward the rear upper side along the inclined surface partitioning the rear side of the recess 43.

The detaching cam 45 is pivoted against the urging force of the urging member (not shown) and arranged on a detaching position (not shown).

When both of the pressing cam 44 and the detaching cam 45 are on the standby positions, the lower end portion of the curved portion 47 of the pressing cam 44 is opposed to the front side surface of the detaching portion 54 of the detaching cam 45 from the front side slightly at an interval (see FIG. 4).

(2) Developer Cartridge

Figure 5:
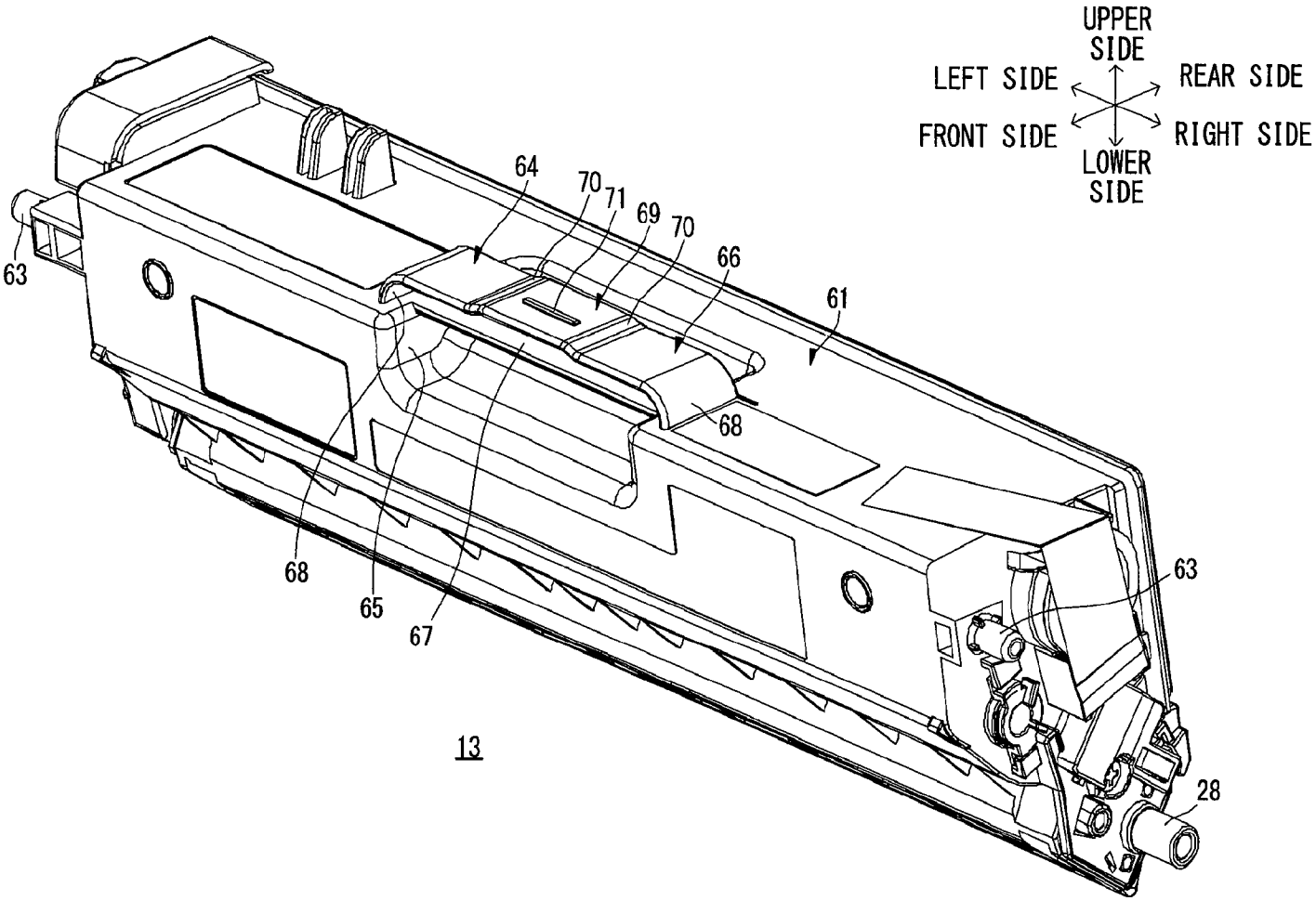
FIG. 5 is a perspective view of a developer cartridge shown in FIG. 1, as viewed from the upper right side.

Each developer cartridge 13 includes a developer casing 61 as an example of a casing forming the outer shape thereof and the developing roller 17 (see FIG. 1), as shown in FIG. 5.

The developer casing 61 is generally in the form of a box longitudinal in the right-and-left direction. An opening 62 (see FIG. 1) is formed in the rear lower end portion of the developer casing 61 entirely over the right-and-left direction.

The developer casing 61 rotatably supports both end portions of the developing roller shaft 28 of the developing roller 17 in the right-and-left direction, to receive the developing roller 17 in the opening 62.

The developing roller shaft 28, serving as the rotating shaft of the developing roller 17, is supported to protrude from both end portions of the developer casing 61 in the right-and-left direction outward in the right-and-left direction.

Thus, the developing roller 17 is supported on the lower end portion of the developer casing 61, to be rotatable along the right-and-left direction.

The developer casing 61 includes a pair of right and left bosses 63 as examples of a pressed portion.

The bosses 63 are provided on the front upper end portions of the right and left end surfaces of the developer casing 61, generally in the form of cylinders protruding outward in the right-and-left direction.

The developer casing 61 integrally includes a grip 64 as an example of a grip member. A notched portion 65 is formed on the developer casing 61 under the grip 64.

The grip 64 is formed on a central portion of the front upper end portion of the developer casing 61 in the right-and-left direction, to extend in the right-and-left direction. The grip 64 is an abutted portion abutted by an abutting member 81 (described later) of the main body casing 2 when the process unit 9 is mounted on the main body casing 2, and includes a swelling portion 66 and an opposed portion 67.

The swelling portion 66 is formed to swell out upward from the upper end portion of the developer casing 61. The swelling portion 66 includes a pair of upright portions 68 and a coupling portion 69.

The upright portions 68 are right and left leg portions of the swelling portion 66 and arranged at an interval from each other in the right-and-left direction, to extend upward from the upper end portion of the developer casing 61.

The coupling portion 69 is provided generally in the form of an rectangular thin flat plate elastically deformable in the vertical direction, to extend in the right-and-left direction, have no elasticity in the anteroposterior direction, and have elasticity in the vertical direction.

More specifically, the coupling portion 69 is continuous to the upper end portions of the upright portions 68 in a bent manner, to couple the upright portions 68 with each other. The coupling portion 69 includes step portions 70 between a central portion in the right-and-left direction and both end portions in the right-and-left direction, and is so formed that the central portion in the right-and-left direction swells out upward beyond both end portions in the right-and-left direction through the step portions 70.

Each step portion 70 extends obliquely toward the right upper side or the left upper side, to couple the central portion of the coupling portion 69 in the right-and-left direction and the corresponding end portion in the right-and-left direction with each other.

A rib 71 is formed on the upper surface of the central portion of the coupling portion 69 in the right-and-left direction.

The rib 71 is generally in the form of a straight line extending along the right-and-left direction. The rib 71 is formed generally over the entire central portion of the coupling portion 69 in the right-and-left direction.

The opposed portion 67 is higher in rigidity than the coupling portion 69, and generally in the form of a rectangular flat plate extending in the right-and-left direction in plan view. The opposed portion 67 is opposed to the coupling portion 69 at an interval from the lower side and arranged between the lower end portions of the upright portions 68, to be extended between the upper end portions of right and left sidewalls of the notched portion 65. The upper surface of the opposed portion 67 is generally flush with the upper surface of the developer casing 61. Stopper ribs 72 are provided on the upper end surface of the opposed portion 67.

Figure 6:
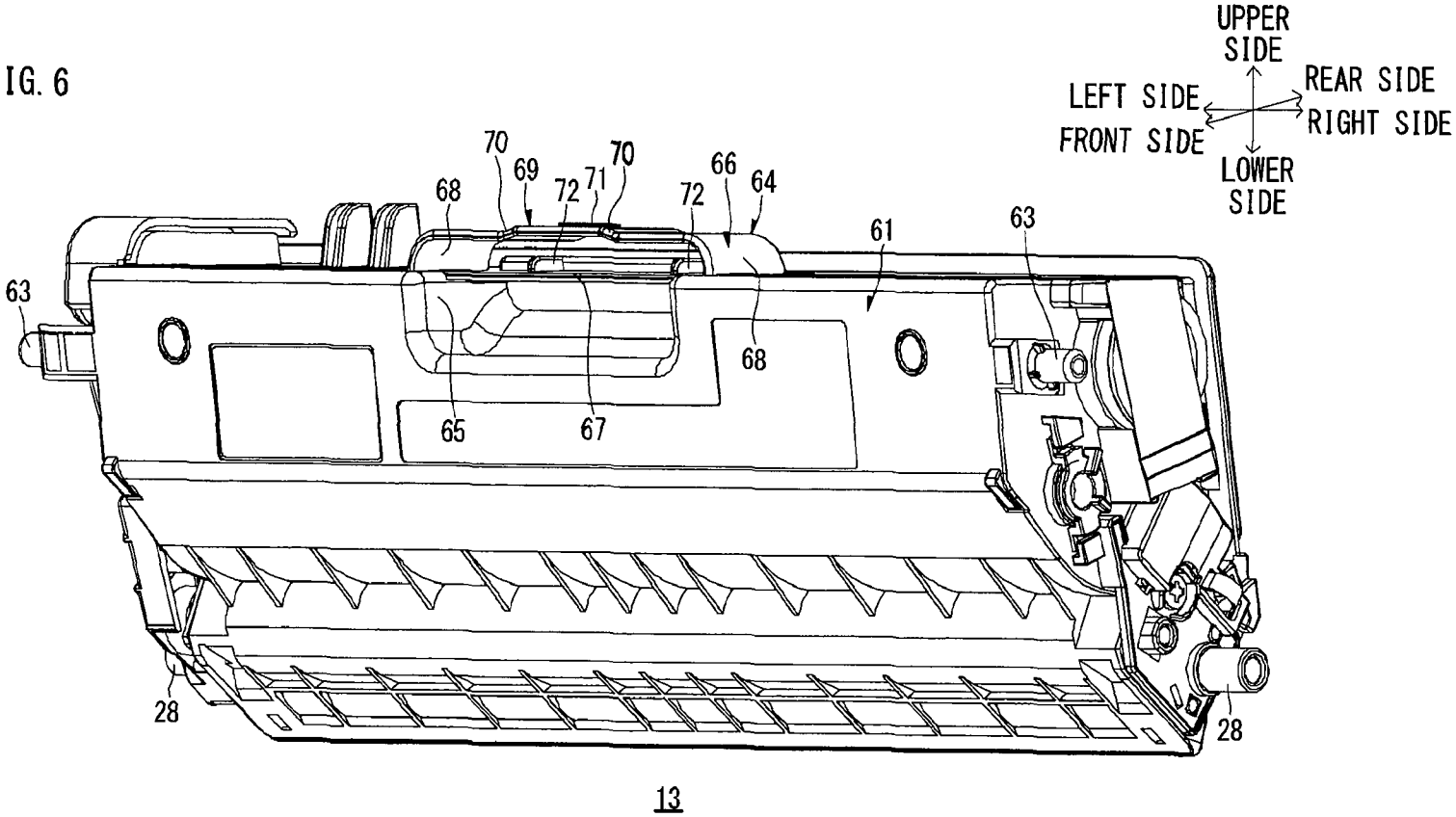
FIG. 6 is a perspective view of the developer cartridge shown in FIG. 1, as viewed from the right front side.

The stopper ribs 72 are projections protruding upward from the upper surface of the opposed portion 67 toward the coupling portion 69 and extending in the anteroposterior direction, as shown in FIG. 6. The stopper ribs 72 are provided one by one on the lower sides of both end portions of the coupling portion 69 in the right-and-left direction. The vertical length of the stopper ribs 72 is about half the vertical interval between the opposed portion 67 and both end portions of the coupling portion 69 in the right-and-left direction.

The notched portion 65 is notched from the upper edge of the developer casing 61 toward the lower side in a generally U shape opened upward in front elevational view to be opposed to the coupling portion 69 on the lower side of the grip 64, and notched from the upper edge of the developer casing 61 toward the rear side in a generally U shape opened frontward in front elevational view. The vertical length of the notched portion 65 is about ⅕ of the vertical length of the developer cartridge 13, while the anteroposterior length of the notched portion 65 is about twice the anteroposterior length of the grip 64 (see FIG. 2).

3. Details of Main Body Casing

The main body casing 2 is provided with the abutting member 81 as an example of an abutting portion, as shown in FIG. 1.

The abutting member 81 has a prescribed length in the right-and-left direction, and is generally in the form of a trapezoid whose lower side is shorter than the upper side. The abutting member 81 is arranged generally at the center of the main body casing 2 in the right-and-left direction, to abut a central portion of the grip 64 of each developer cartridge 13 in the right-and-left direction on the lower rear side of the scanner unit 8. The abutting member 81 includes a first abutting surface 82, a horizontal surface 87 and a second abutting surface 83.

The first abutting surface 82 is the front end face of the abutting member 81, and includes a vertical surface 86 and a first inclined surface 84.

The vertical surface 86 is generally in the form of a straight line extending downward from the front upper end portion of the abutting member 81 in side elevational view. The vertical surface 86 is formed in such a vertical length that the same does not abut the grip 64 of the developer cartridge 13. More specifically, the vertical length of the vertical surface 86 is not more than about half the vertical length of the abutting member 81.

The first inclined surface 84 is generally in the form of a straight line extending continuously from the lower end portion of the vertical surface 86 to be inclined downward toward the rear side in side elevational view. The angle of inclination of the first inclined surface 84 with respect to the horizontal surface 87 is about 45°. A curved surface 88 bent downward toward the rear side is formed on the lower end portion of the first inclined surface 84.

The curved surface 88 is so bent that a normal line at a point abutting the grip 64 is directed downward when the grip 64 of the developer cartridge 13 is abutted.

The horizontal surface 87 is generally in the form of a straight line extending in the anteroposterior direction continuously to the lower end portion of the first inclined surface 84 in side elevational view. The front end portion of the horizontal surface 87 is continuous to the lower end portion of the first inclined surface 84, to have a smooth bent shape in side elevational view.

The second abutting surface 83 is the rear end surface of the abutting member 81, and includes a second inclined surface 85.

The second inclined surface 85 is generally in the form of a straight line extending continuously to the rear end portion of the horizontal surface 87 to be inclined downward toward the front side in side elevational view. The angle of inclination of the second inclined surface 85 with respect to the horizontal surface 87 is about 30°, which is smaller than the angle of inclination of the first inclined surface 84 with respect to the horizontal surface 87. The front end portion of the second inclined surface 85 is continuous to the rear end portion of the horizontal surface 87, to have a smooth bent shape in side elevational view.

4. Attachment/Detachment of Developer Cartridge to/from Main Body Casing (1) Attachment/Detachment of Developer Cartridge to/from Process Frame In order to mount the developer cartridges 13 on the main body casing 2, the developer cartridges 13 are first mounted on the process frame 12, as shown in FIG. 7.

In order to mount each developer cartridge 13 on the process frame 12, the user first swings the front cover 5 of the color laser printer 1 frontward to expose the attachment/detachment port 30, and thereafter draws the process frame 12 out of the main body casing 2 frontward.

Then, the user grasps the grip 64 of the developer cartridge 13, and arranges the developer cartridge 13 on a position matching with the corresponding photosensitive drum 14 in the anteroposterior direction on the upper side of the process frame 12.

At this time, the user inserts his/her fingers into the notched portion 65 of the developer cartridge 13 from the front side, and grasps the grip 64 from under the opposed portion 67.

Then, the user lowers the developer cartridge 13, and inserts the same into the process frame 12 from the lower end portion thereof.

As the developer cartridge 13 is inserted into the process frame 12, both end portions of the developing roller shaft 28 in the right-and-left direction are fitted into the first guide grooves 39A of the corresponding guide grooves 39 from above on the side plates 33 of the process frame 12. In other words, the left end portion of the developing roller shaft 28 is fitted into the first guide groove 39A of the left side plate 33 from above, while the right end portion of the developing roller shaft 28 is fitted into the first guide groove 39A of the right side plate 33 from above.

Thus, both end portions of the developing roller shaft 28 are guided by the first guide grooves 39A of the guide grooves 39, whereby the developer cartridge 13 is inserted into the process frame 12 along the first inclinational direction X to be directed slightly rearward toward the lower side, as shown in FIG. 4. In other words, the first inclinational direction X is along a mounting direction for the developer cartridge 13 with respect to the process frame 12.

After both end portions of the developing roller shaft 28 in the right-and-left direction reach the lower end portions of the first guide grooves 39A of the guide grooves 39, the developer cartridge 13 is continuously inserted into the process frame 12.

Then, both end portions of the developing roller shaft 28 in the right-and-left direction are guided by the second guide grooves 39B of the corresponding guide grooves 39, to move along the second inclinational direction Y and reach the deepest portions of the second guide grooves 39B.

Thus, the developer cartridge 13 is arranged on the detached position.

At this time, both of the pressing cam 44 and the detaching cam 45 are on the standby positions, while the lower end portion of the curved portion 47 of the pressing cam 44 and the front side surface of the detaching portion 54 of the detaching cam 45 are opposed to each other at an interval smaller than the radial length of each of the right and left bosses 63 (shown by a broken line in FIG. 4) of the developer cartridge 13. The developing roller 17 is in contact with the corresponding photosensitive drum 14 to be along the radial direction of the photosensitive drum 14 from the front upper side along the second inclinational direction Y.

Each boss 63 of the developer cartridge 13 is in contact with the pressing cam 44 and the detaching cam 45 from above, to be opposed to the opposed portions of the pressing cam 44 and the detaching cam 45 from the rear upper side.

In other words, the boss 63 is detached from the pressing cam 44, and released from pressing by the pressing cam 44. When arranged on the detached position, therefore, the developer cartridge 13 is detachable from the process frame 12.

In the state where the developer cartridge 13 is on the detached position, the user grasps the grip 64 and pivots the developer cartridge 13 frontward.

At this time, the user continuously inserts his/her fingers into the rear end portion of the notched portion 65 of the developer cartridge 13 and pulls the grip 64 frontward while grasping the same from the rear side. Thus, the developer cartridge 13 is pivoted on the developing roller shaft 28 frontward, and the boss 63 moves to the front lower side toward the space between the pressing cam 44 and the detaching cam 45 located on the standby positions, following the pivoting of the developer cartridge 13 around the developing roller shaft 28.

At this time, the boss 63 presses the lower end portion of the curved portion 47 of the pressing cam 44 located on the standby position toward the front upper side, to spread the space between the pressing cam 44 and the detaching cam 45.

Thus, the pressing cam 44 is pivoted toward the front upper side, and moved to the pressing position. When the pressing cam 44 is arranged on the pressing position, the pressing cam 44 is apart from the detaching cam 45, the space between the curved portion 47 of the pressing cam 44 and the front side surface of the detaching portion 54 of the detaching cam 45 is spread, and the boss 63 enters the space between the pressing cam 44 and the detaching cam 45.

The contact positions of the boss 63 and the pressing cam 44 (the curved portion 47) are so set that the rotating shaft 48 of the pressing cam 44 is not present in the direction where the boss 63 presses the pressing cam 44 when the developer cartridge 13 is moved from the detached position to the imaging position. Therefore, the pressing cam 44 is so pressed by the boss 63 that the same is smoothly pivoted toward the front upper side.

When the developer cartridge 13 is pivoted, the pressing cam 44 is first in contact with the boss 63 from the front side, and thereafter moves toward the front upper side while keeping the contact state (see FIG. 4). While the developer cartridge 13 is pivoted, therefore, the pressing cam 44 does not at least upwardly press the boss 63 of the developer cartridge 13, and the developer cartridge 13 can be prevented from abruptly floating up.

When the boss 63 enters the space between the pressing cam 44 and the detaching cam 45, the pressing cam 44 engages with the boss 63 from above, and presses the boss 63 toward the rear lower side due to the urging force of the urging member (not shown). In other words, the developer cartridge 13 is pressed by the pressing cam 44 toward the rear lower side.

At this time, the developer cartridge 13 is pressed by the pressing cam 44 toward the rear lower side, while the developing roller shaft 28 is guided by the second guide grooves 39B of the side plates 33, so that the developer cartridge 13 is brought into pressure contact with the corresponding photosensitive drum 14 from the front upper side along the second inclinational direction Y.

The developer cartridge 13 is brought into pressure contact with the corresponding photosensitive drum 14 from the front upper side, due to a component of force in the second inclinational direction Y in the pressing force of the pressing cam 44 pressing the boss 63.

Further, the developer cartridge 13 is prevented from floating upward, due to a lower component of force in the pressing force of the pressing cam 44 pressing the boss 63.

Thus, the developer cartridge 13 is moved from the detached position to the imaging position and pressed by the pressing cam 44, to be completely mounted on the process frame 12.

All developer cartridges 13 are mounted on the process frame 12 through similar procedures.

Each developer cartridge 13 is detached from the process frame 12 through a procedure reverse to that for mounting the developer cartridge 13 on the process frame 12.

In other words, the user first grasps the grip 64 and pivots the developer cartridge 13 from the imaging position to the detached position.

When the developer cartridge 13 is on the detached position, the user grasps the grip 64 and draws the developer cartridge 13 upward, thereby detaching the same from the process frame 12.

(2) Attachment/Detachment of Process Unit to/from Main Body Casing

Then, the process unit 9 (the process frame 12 mounted with all developer cartridges 13) is mounted on the main body casing 2.

Figure 7:
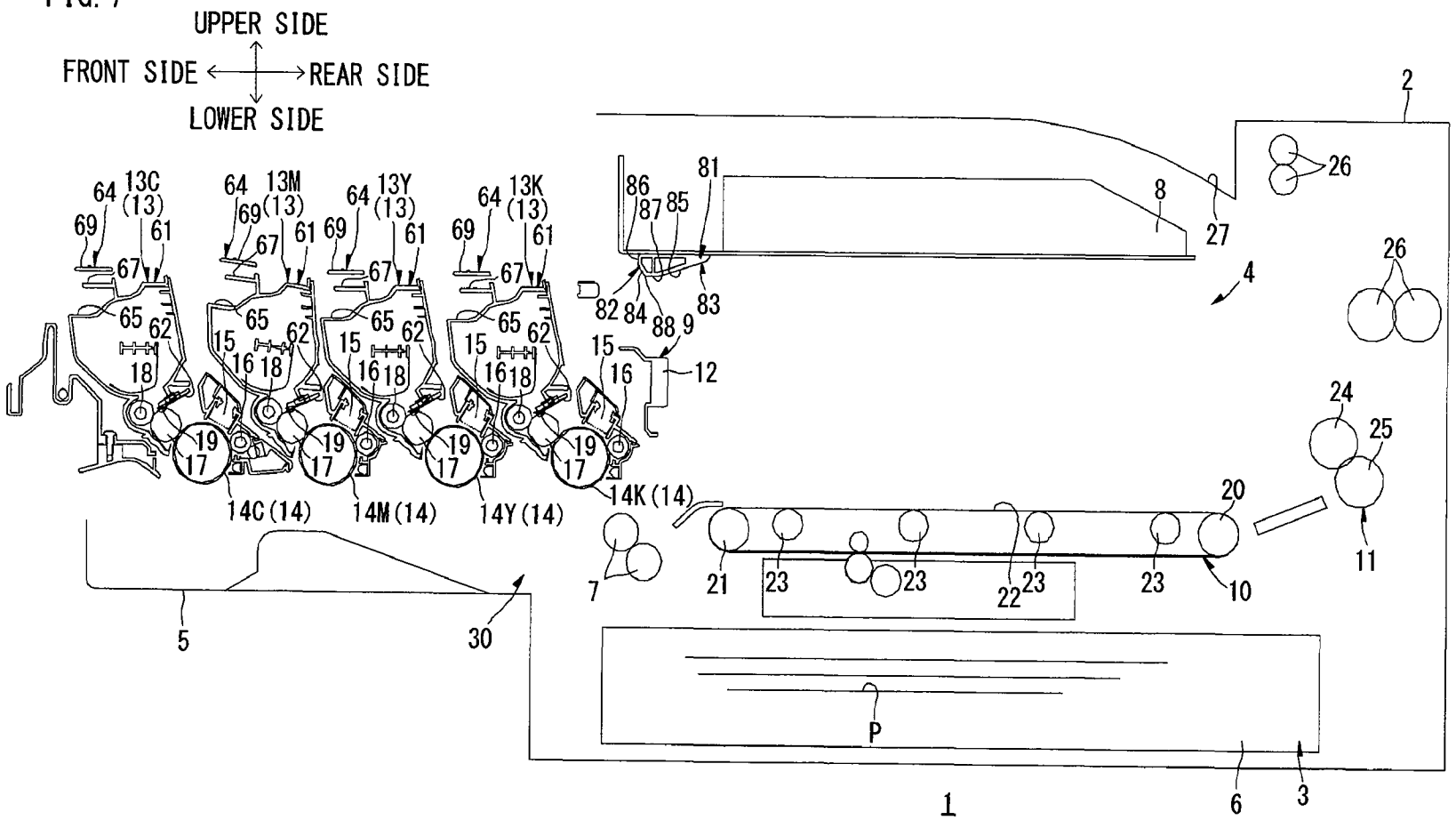
FIG. 7 is an explanatory diagram for illustrating mounting of the process cartridge shown in FIG. 1 on a main body casing, showing such a state that a magenta developer cartridge is arranged on a detached position while remaining developer cartridges are arranged on imaging positions.

In order to slide the process unit 9 to a mounted position with respect to the main body casing 2, the process unit 9 is inserted into the main body casing 2 rearward, as shown in FIG. 7.

At this time, the right and left guide rails 37 and the rollers 38 (see FIG. 2) of the process frame 12 engage with guide members (not shown) in the main body casing 2. The process unit 9 is received in the main body casing 2 while each photosensitive drum 14 is detached from the transport belt 22 slightly upward (the process unit 9 itself is not in contact with the transport belt 22). The abutting member 81 is exposed from the attachment/detachment port 30.

When the front handle 34 is grasped and the process unit 9 is pushed rearward, the process unit 9 is directed rearward in a generally horizontal direction and inserted into the main body casing 2, as the guide rails 37 and the rollers 38 (see FIG. 2) are guided by the guide members (not shown) but not in contact with the transport belt 22.

At this time, any of the developer cartridges 13 may be arranged not on the imaging position but on the detached position (refer to the magenta developer cartridge 13M), as shown in FIG. 7. If the process unit 9 is arranged on the mounted position with respect to the main body casing 2 while any of the developer cartridges 13 is on the detached position, the developer cartridge 13 interferes with the laser beam from the scanner unit 8 to the corresponding photosensitive drum 14, and hence the color laser printer 1 cannot form images.

Figure 8:
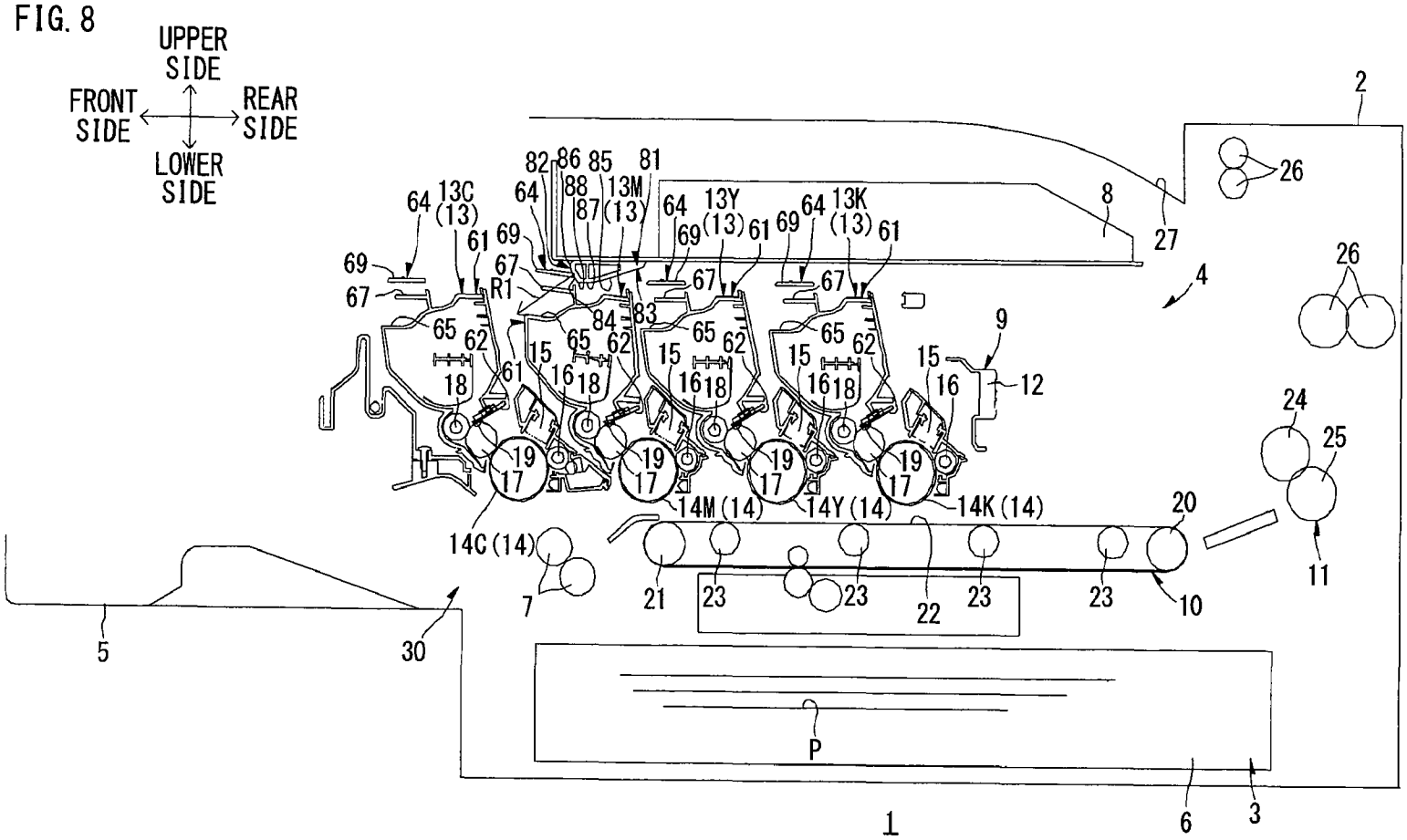
FIG. 8 is an explanatory diagram for illustrating the mounting of the process cartridge on the main body casing subsequently to FIG. 7, showing a state where a grip of the magenta developer cartridge is abutted by an abutting member from the front side.

In this case, the grip 64 of the developer cartridge 13 abuts the abutting member 81 of the main body casing 2 from the front side when the process unit 9 is inserted into the main body casing 2, whereby the developer cartridge 13 is pivoted rearward and moved from the detached position to the imaging position, as shown in FIG. 8.

More specifically, the central portion of the grip 64 of the developer cartridge 13 in the right-and-left direction first abuts the first inclined surface 84 of the abutting member 81 from the front side.

Therefore, the grip 64 is pressed toward the front oblique lower side perpendicular to the first inclined surface 84, due to reaction force R1 from the first inclined surface 84.

Figure 9:
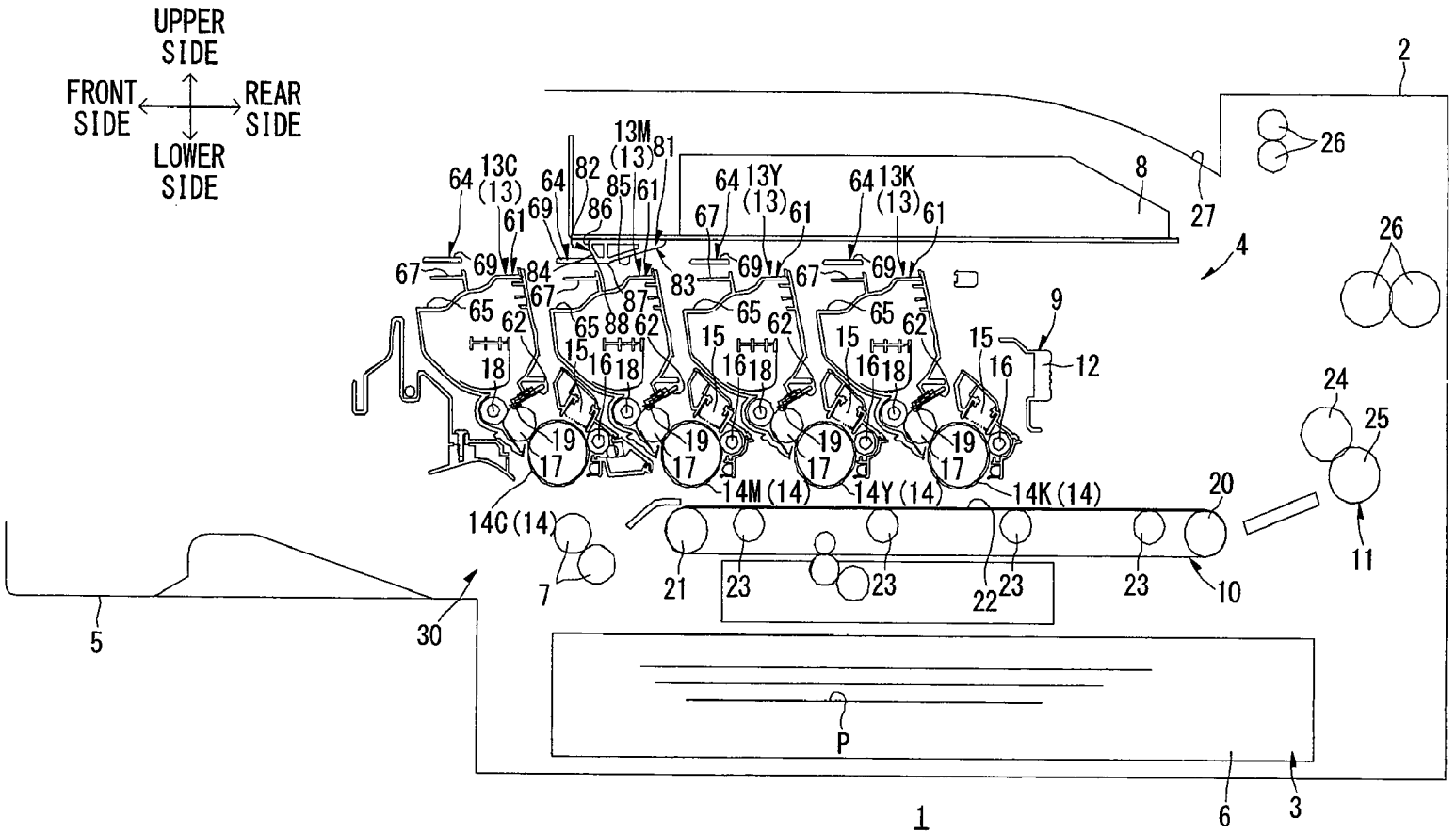
FIG. 9 is an explanatory diagram for illustrating the mounting of the process cartridge on the main body casing subsequently to FIG. 8, showing a state where the magenta developer cartridge is pivoted from the detached position to an imaging position.

Thus, the developer cartridge 13 is pivoted frontward as shown in FIG. 9, and moved from the detached position to the imaging position, as described above. When the developer cartridge 13 is so arranged on the imaging position that the process unit 9 is arranged on the mounted position with respect to the main body casing 2, the developer cartridge 13 is retreated from the laser beam from the scanner unit 8 to the corresponding photosensitive drum 14, and the color laser printer 1 can form images.

At this time, the grip 64 of the developer cartridge 13 abuts the curved surface 88 of the first inclined surface 84 on the front end portion thereof. The coupling portion 69 of the grip 64 is arranged on an unloaded position as an example of a first position where no pressing force from the curved surface 88 acts thereon.

When the process unit 9 is further inserted into the main body casing 2, the grip 64 of the developer cartridge 13 is pressed by the curved surface 88 toward the lower side.

Figure 10:
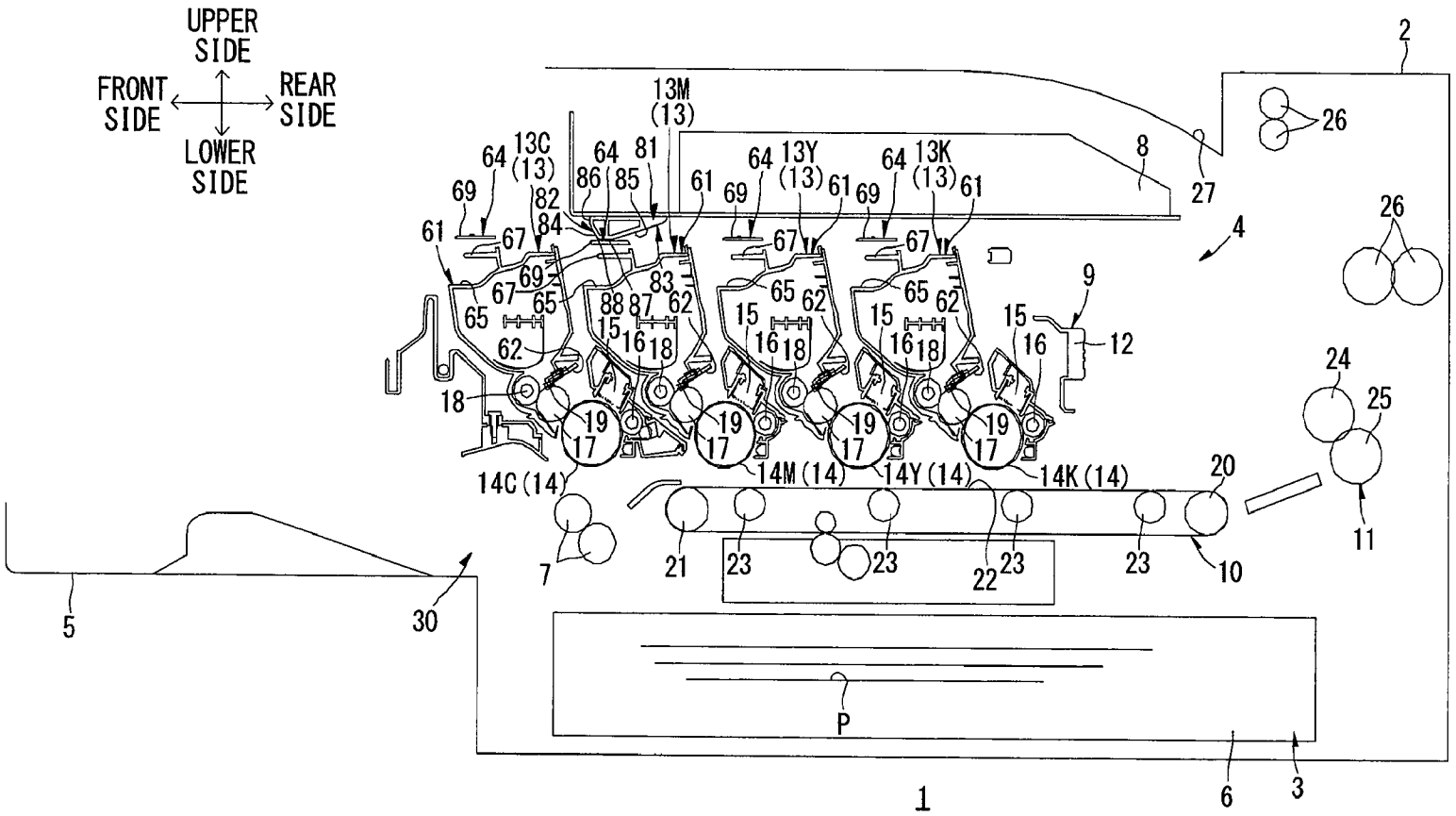
FIG. 10 is an explanatory diagram for illustrating the mounting of the process cartridge on the main body casing subsequently to FIG. 9, showing a state where the grip of the magenta developer cartridge is deflected and the magenta developer cartridge passes through a space under the abutting member.

Thus, the grip 64 is deflected downward on the central portion thereof in the right-and-left direction and moved to a loaded position as an example of a second position located under the unloaded position, as shown in FIG. 10. The grip 64 creeps into the space under the abutting member 81 along the curved surface 88, and passes through the space under the abutting member 81 while sliding with the horizontal surface 87.

When the developer cartridges 13 are mounted on the process frame 12, the developer cartridges 13 (the black, yellow and cyan developer cartridges 13K, 13Y and 13C in FIG. 7) inserted into the main body casing 2 in the states arranged on the imaging positions abut the curved surface 88 of the first inclined surface 84 from the front side on the front end portions of the grips 64 thereof similarly to the magenta developer cartridge 13M shown in FIG. 9, and the grips 64 are thereafter deflected downward (moved to loaded positions located under unloaded positions) so that the developer cartridges 13 pass through the space under the abutting member 81, as shown in FIG. 10.

If the coupling portion 69 of the grip 64 of any developer cartridge 13 is excessively deflected downward, the lower surface of the coupling portion 69 is abutted by the upper end portions of the stopper ribs 72, so that further deflection is limited. In other words, downward deflection of the grip 64 is limited by the stopper ribs 72 from below.

When the process unit 9 is completely inserted into the main body casing 2 as shown in FIG. 1, the aforementioned guide rails 37 and the rollers 38 of the process unit 9 are detached from the aforementioned guide members (not shown) in the main body casing 2.

Then, the process unit 9 moves down, and each photosensitive drum 14 comes into contact with the transport belt 22 from above.

Thus, the process unit 9 is slid to the mounted position, and completely mounted on the main body casing 2.

In order to slide the process unit 9 mounted on the main body casing 2 to the drawn-out position with respect to the main body casing 2, the user swings the front cover 5 frontward to expose the attachment/detachment port 30, and thereafter grasps the front handle 34 to draw out the process unit 9 frontward, as shown in FIG. 7.

At this time, an impact may be so externally applied to the color laser printer 1 that any of the developer cartridge 13 is moved from the imaging position to the detached position in the main body casing 2.

Figure 11:
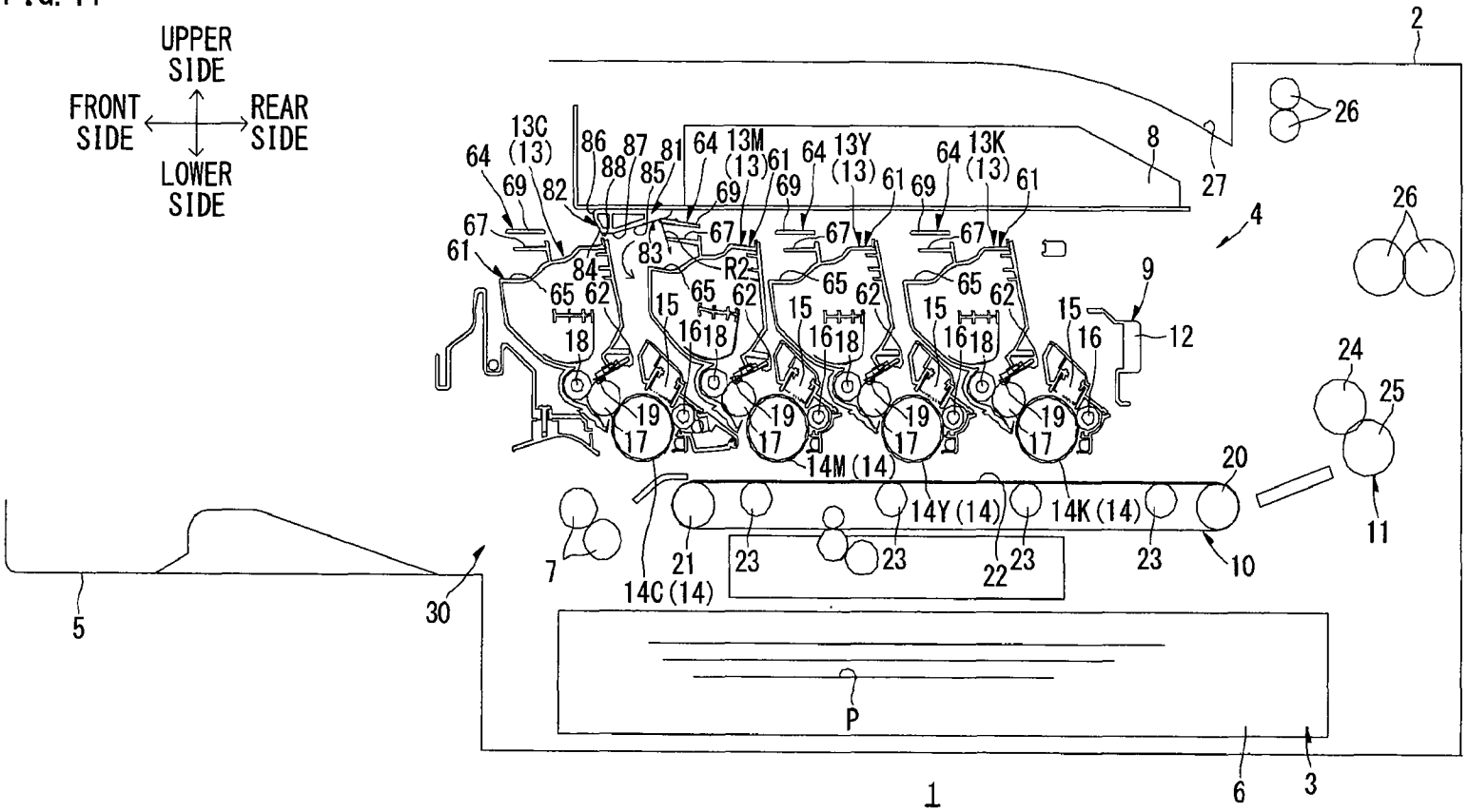
FIG. 11 is an explanatory diagram for illustrating detachment of the process cartridge shown in FIG. 1 from the main body casing, showing a state where the grip of the magenta developer cartridge is abutted by the abutting member from the rear side.

In this case, the grip 64 of the developer cartridge 13 abuts the abutting member 81 of the main body casing 2 from the rear side when the process unit 9 is drawn out of the main body casing 2, as shown in FIG. 11.

More specifically, the central portion of the grip 64 of the developer cartridge 13 in the right-and-left direction abuts the second inclined surface 85 of the abutting member 81 from the rear side.

Thus, the front end portion of the grip 64 is vertically pressed against the second inclined surface 85 due to reaction force R2 from the second inclined surface 85. More specifically, the grip 64 is pressed toward a direction slightly inclined rearward toward the lower side.

Then, the front end portion of the grip 64 is pressed by the second inclined surface 85 from the upper side toward the lower side, and the developer cartridge 13 is pivoted frontward.

Thus, the developer cartridge 13 is moved from the detached position to the imaging position, as hereinabove described.

When the process unit 9 is further drawn out of the main body casing 2, the central portion of the grip 64 in the right-and-left direction is so deflected downward that the developer cartridge 13 creeps into the space under the abutting member 81 along the curved surface 88, and passes through the space under the abutting member 81.

When all developer cartridges 13 pass through the space under the abutting member 81 in the aforementioned manner and the process unit 9 is completely drawn out of the main body casing 2, the process unit 9 is arranged on the drawn-out position with respect to the main body casing 2.

5. Contact/Detaching Operation of Developer Cartridge with Respect to Photosensitive Drum Contact/detaching operations of each developer cartridge 13 with respect to the corresponding photosensitive drum 14 are now described with reference to FIG. 4.

The color laser printer 1 can be switched between a color mode for forming color images and a monochromatic mode for forming black-and-white images.

In the color mode, all developer cartridges 13 are in contact with all photosensitive drums 14, as hereinabove described.

In the monochromatic mode, the black developer cartridge 13K is in contact with the black photosensitive drum 14K, while the remaining developer cartridges 13 (the yellow, magenta and cyan developer cartridges 13Y, 13M and 13C) are detached from the remaining photosensitive drums 14 (the yellow, magenta and cyan photosensitive drums 14Y, 14M and 14C) respectively, although this state is not shown.

In order to detach each developer cartridge 13 from the corresponding photosensitive drum 14, a translation cam mechanism (not shown) or the like provided in the main body casing 2 presses the protrusion 56 of the detaching cam 45 corresponding to the developer cartridge 13 to be detached from the photosensitive drum 14.

Thus, the detaching cam 45 is pivoted on the rotating shaft 55 clockwise in right side elevational view, against the urging force of the urging member (not shown).

Then, the detaching portion 54 of the detaching cam 45 is pivoted on the rotating shaft 55 obliquely toward the front upper side, to press the boss 63 of the developer cartridge 13 obliquely toward the front upper side.

At this time, the boss 63 of the developer cartridge 13 is pressed by the detaching cam 45 obliquely toward the front upper side, and presses the pressing cam 44 upward from below.

Thus, the developer cartridge 13 is lifted obliquely toward the front upper side. At the same time, the developing roller shaft 28 is guided by the second guide grooves 39B of the side plates 33, and moved obliquely toward the front upper side along the second inclinational direction Y.

Thus, the developer cartridge 13 is detached from the photosensitive drum 14.

In order to bring the developer cartridge 13 detached from the photosensitive drum 14 into contact with the photosensitive drum 14 again, the protrusion 56 of the detaching cam 45 is released from the pressing.

Then, the boss 63 of the developer cartridge 13 is pressed by the pressing cam 44 again, as hereinabove described.

Thus, the developing roller shaft 28 is guided by the second guide grooves 39B of the side plates 33, whereby the developer cartridge 13 is brought into pressure contact with the photosensitive drum 14 obliquely from the front upper side along the second inclinational direction Y.

6. Functions/Effects (1) According to each developer cartridge 13, the coupling portion 69 couples the pair of upright portions 68 extending from the upper end portion of the developer casing 61 toward the detaching direction (the upper side) for the developer cartridge 13 with each other, as shown in FIG. 5. In other words, the coupling portion 69 is arranged upward beyond the upper end portion of the developer casing 61.

Even if a peripheral member such as the abutting member 81 interferes with the developer cartridge 13 from above when the process unit 9 is slid with respect to the main body casing 2, therefore, the elastically deformable coupling portion 69 is so deflected that an impact resulting from the interference can be relaxed.

Further, the user can easily grasp the coupling portion 9, for easily attaching/detaching the developer cartridge 13 to/from the process unit 9.

Consequently, the developer cartridge 13 can be easily attached to/detached from the process unit 9, and can be prevented from breakage resulting from interference with the peripheral member such as the abutting member 81.

(2) According to each developer cartridge 13, the notched portion 65 notched from the upper end portion of the developer casing 61 toward the lower side is formed on the upper end portion of the developer casing 61 to be opposed to the coupling portion 69, as shown in FIG. 5.

Therefore, the user can easily grasp the grip 64 by inserting his/her fingers into the space between the notched portion 65 and the grip 64.

(3) According to each developer cartridge 13, the grip 64 includes the opposed portion 67 opposed to the coupling portion 69 at the interval on the side of the developer casing 61 and higher in rigidity than the coupling 69, as shown in FIG. 6.

Therefore, the grip 64 can ensure elasticity by the coupling portion 69, while ensuring rigidity by the opposed portion 67.

(4) According to each developer cartridge 13, the upper surface of the opposed portion 67 is generally flush with the upper surface of the developer casing 61, as shown in FIG. 6.

Therefore, the structure of the grip 64 can be simplified, and the user can easily recognize the position of the opposed portion 67.

(5) According to each developer cartridge 13, the opposed portion 67 includes the stopper ribs 72 protruding from the upper end portion of the opposed portion 67 toward the coupling portion 69 for limiting elastic deformation of the coupling portion 69 from below.

When the peripheral member such as the abutting member 81 interferes with the developer cartridge 13 from above to deflect the coupling portion 69, therefore, the deflection of the coupling portion 69 can be limited from below.

Consequently, the coupling portion 69 can be prevented from breakage resulting from excess deflection.

(6) According to each developer cartridge 13, the coupling portion 69 is so formed that the central portion thereof swells out upward beyond both end portions in the right-and-left direction, and includes the step portions 70 between the central portion and both end portions, as shown in FIG. 5.

When a peripheral member such as the abutting member 81 interferes with the developer cartridge 13 from above to deflect the coupling portion 69, therefore, the central portion abutted by the peripheral member such as the abutting member 81 is deflected. Then, both end portions absorb the deflection of the central portion.

Consequently, stress resulting from the deflection of the central portion is not concentrated on the central portion, but can be dispersed.

(7) According to each developer cartridge 13, the coupling portion 69 includes the rib 71 extending along the right-and-left direction on the upper end portion of the central portion, as shown in FIG. 5.

Therefore, rigidity of the central portion can be so ensured that the central portion can be prevented from breakage resulting from excess deflection.

(8) According to each developer cartridge 13, the coupling portion 69 has elasticity in the vertical direction, and has no elasticity in the anteroposterior direction.

Therefore, an impact resulting from interference by the peripheral member such as the abutting member 81 from above can be reliably relaxed by deflecting the coupling portion 69 downward.

(9) According to each developer cartridge 13, the upright portions 68 and the coupling portion 69 constitute the grip 64 to be grasped for attaching/detaching the developer cartridge 13 to/from the process unit 9, as shown in FIG. 5.

Therefore, the structure of the developer cartridge 13 can be simplified without separately providing the grip 64.

The grip 64 is arranged on the unloaded position where no pressing force from the peripheral member such as the abutting member 81 acts thereon when the process unit 9 is arranged on the drawn-out position, and moved to the loaded position located under the unloaded position by elastic deformation in the process of the movement of the process unit 9 from the drawn-out position to the mounted position.

Even if the peripheral member such as the abutting member 81 interferes with the grip 64 from above the developer cartridge 13 in the process of the movement of the process unit 9 from the drawn-out position to the mounted position, therefore, an impact resulting from the interference from above the developer cartridge 13 can be reliably relaxed by deflecting the grip 64 from the unloaded position to the lower loaded position.

(10) According to each developer cartridge 13, the grip 64 is arranged at the center of the developer casing 61 in the right-and-left direction, as shown in FIG. 5.

When the developer cartridge 13 is attached to/detached from the process unit 9, therefore, the central portion of the developer cartridge 13 in the right-and-left direction can be grasped.

Consequently, the developer cartridge 13 can be attached to/detached from the process unit 9 with the simple structure, while balancing the developer cartridge 13 in the right-and-left direction.

(11) According to each developer cartridge 13, the developer casing 61 integrally includes the grip 64, as shown in FIG. 5.

Therefore, the developer casing 61 and the grip 64 can be integrally molded, and the developer cartridge 13 can be manufactured at a low cost.

<Second Embodiment>

While the color laser printer 1 includes the scanner unit 8 emitting the laser beams for exposing the photosensitive drums 14 as shown in FIG. 1, the scanner unit 8 may be replaced with an LED for exposing the photosensitive drums 14.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developer cartridge comprising:

a developing roller including a developing roller shaft extending in a first direction;

a casing, the developing roller being positioned closer to one side of the casing than to an other side of the casing in a second direction different from the first direction, and the casing including:

a swelling portion swelling out from an outer surface of the other side of the casing, the swelling portion contacting and being fixedly attached to the outer surface of the other side at a first contact point and at a second contact point, the swelling portion having a coupling portion extending between the first contact point and the second contact point in the first direction and spaced apart from the outer surface of the casing in the second direction;

a notched portion being notched from an outer surface of the casing, the notched portion being positioned between the developing roller and the swelling portion in the second direction; and an opposed portion extending in the first direction, the opposed portion being overlapped by and spaced apart from the swelling portion in the second direction and wherein the opposed portion overlaps and is spaced apart from the notched portion in the second direction, wherein the opposed portion has a first rigidity and the swelling portion has a second rigidity less than the first rigidity, and wherein the first contact point, the second contact point, the coupling portion, and at least a part of the notched portion are aligned in the first direction such that an imaginary straight line parallel to the first direction intersects each of the first contact point, the second contact point, the coupling portion and the at least a part of the notched portion.

2. The developer cartridge according to claim 1, wherein the swelling portion includes:

a first upright portion extending from the outer surface of the other side at the first contact point;

a second upright portion extending from the outer surface of the other side at the second contact point, the second upright portion spaced apart from the first upright portion in the first direction, and wherein the coupling portion couples the first upright portion and the second upright portion in the first direction.

3. The developer cartridge according to claim 2, wherein the opposed portion is arranged between the first upright portion and the second upright portion in the first direction.

4. The developer cartridge according to claim 3, wherein the casing further includes:

a first stopper rib protruding from the opposed portion toward the coupling portion.

5. The developer cartridge according to claim 4, wherein the casing further includes:

a second stopper rib protruding from the opposed portion toward the coupling portion, the second stopper rib spaced apart from the first stopper rib in the first direction.

6. The developer cartridge according to claim 3, wherein the casing further includes:

a pair of stopper ribs, each of the pair of stopper ribs protruding from the opposed portion toward the coupling portion.

7. The developer cartridge according to claim 1, wherein the coupling portion has the second rigidity.

8. The developer cartridge according to claim 1, wherein the casing further includes:

a rib extending in the first direction, the rib being positioned on a surface of the coupling portion.

9. The developer cartridge according to claim 1, wherein the second direction is perpendicular to the first direction.

10. The developer cartridge according to claim 1, wherein the casing has a first surface and a second surface separated from the first surface in the first direction, and wherein the casing includes:

a first boss protruding outward in the first direction, the first boss being provided on the first surface, and the first boss being movable with the casing; and a second boss protruding outward in the first direction, the second boss being provided on the second surface, and the second boss being movable with the casing.

11. A developer cartridge comprising:

a developing roller including a developing roller shaft extending in a first direction; and a casing, the developing roller being positioned closer to one side of the casing than to an other side of the casing in a second direction different from the first direction, the casing having a first surface and a second surface separated from the first surface in the first direction, the casing being movable between a first position and a second position relative to a process frame, and the casing including:

a swelling portion swelling out from an outer surface of the other side;

a first boss protruding outward in the first direction, the first boss being provided on the first surface, the first boss being movable with the casing, and the first boss is configured to receive a pressing force in a direction of the developing roller in a case where the casing is in the second position; and a second boss protruding outward in the first direction, the second boss being provided on the second surface, the second boss being movable with the casing, and the second boss is configured to receive a pressing force in a case where the casing is in the second position, wherein the casing is configured to move from the first position to the second position in response to the swelling portion abutting with a first portion of an image forming apparatus, thereby causing the first boss and the second boss to receive the respective pressing force in the direction of the developing roller from at least a second portion of the image forming apparatus, different from the first portion, and wherein the swelling portion abuts with the first portion while the first and second bosses receive the respective pressing force in the direction of the developing roller from at least the second portion of the image forming apparatus, the first portion and the second portion being spaced apart in the second direction.

12. The developer cartridge according to claim 11, wherein the casing further includes:

a notched portion being notched from an outer surface of the casing, the notched portion being positioned between the developing roller and the swelling portion in the second direction.

13. The developer cartridge according to claim 11, wherein the casing further includes:

an opposed portion extending in the first direction, the opposed portion being opposed to the swelling portion at an interval in the second direction.

14. The developer cartridge according to claim 11, wherein the swelling portion includes:

a first upright portion extending from the outer surface of the other side;

a second upright portion extending from the outer surface of the other side, the second upright portion spaced apart from the first upright portion in the first direction; and a coupling portion extending in the first direction, the coupling portion coupling the first upright portion and the second upright portion.

15. The developer cartridge according to claim 14, wherein the casing further includes:

an opposed portion extending in the first direction, the opposed portion being opposed to the swelling portion at an interval in the second direction, and the opposed portion being arranged between the first upright portion and the second upright portion in the first direction.

16. The developer cartridge according to claim 11, wherein the second direction is perpendicular to the first direction.

17. A developer cartridge comprising:

a developing roller including a developing roller shaft extending in a first direction;

a casing, the developing roller being positioned closer to one side of the casing than to an other side of the casing in a second direction different from the first direction, and the casing including:

a swelling portion swelling out from an outer surface of the other side of the casing, the swelling portion contacting and being fixedly attached to the outer surface of the other side at a first contact point and at a second contact point, the swelling portion having a coupling portion extending between the first contact point and the second contact point in the first direction and spaced apart from the outer surface of the casing in the second direction, wherein the swelling portion includes:

a first upright portion extending from the outer surface of the other side at the first contact point;

a second upright portion extending from the outer surface of the other side at the second contact point, the second upright portion spaced apart from the first upright portion in the first direction;

a notched portion being notched from an outer surface of the casing, the notched portion being positioned between the developing roller and the swelling portion in the second direction; and an opposed portion extending in the first direction, the opposed portion being opposed to the swelling portion at an interval in the second direction, and the opposed portion being arranged between the first upright portion and the second upright portion in the first direction, wherein the opposed portion has a first rigidity and the coupling portion has a second rigidity less than the first rigidity, wherein the coupling portion couples the first upright portion and the second upright portion in the first direction, and wherein the first contact point, the second contact point, the coupling portion, and at least a part of the notched portion are aligned in the first direction such that an imaginary straight line parallel to the first direction intersects each of the first contact point, the second contact point, the coupling portion and the at least a part of the notched portion.

* * * * *